United States Patent [19]

Chase

[11] Patent Number: 4,888,590

[45] Date of Patent: Dec. 19, 1989

[54] AIRCRAFT RUNWAY

[75] Inventor: Charles J. Chase, Valencia, Calif.

[73] Assignee: Lockhead Corporation, Calabasas, Calif.

[21] Appl. No.: 225,433

[22] Filed: Jul. 25, 1988

[51] Int. Cl.[4] ..... E01C 9/00; F41H 3/00

[52] U.S. Cl. ..... 342/3; 404/71; 428/919

[58] Field of Search ..... 404/12, 14, 71; 428/919; 342/1-4, 13

[56] References Cited

U.S. PATENT DOCUMENTS

| | | | |
|---|---|---|---|
| 2,527,918 | 10/1950 | Collard | 342/2 |
| 4,287,243 | 9/1981 | Nielsen | 342/3 X |
| 4,659,602 | 4/1987 | Birch | 428/919 X |

FOREIGN PATENT DOCUMENTS

| | | | |
|---|---|---|---|
| 0774780 | 12/1967 | Canada | 342/1 |

*Primary Examiner*—Thomas H. Tarcza
*Assistant Examiner*—Gilberto Barrón, Jr.
*Attorney, Agent, or Firm*—Louis L. Dachs

[57] ABSTRACT

The invention is a reduced radar detectable runway. In detail, the invention comprises a runway having a plurality of holes randomly orientated and randomly dispersed across and along the surface thereof. The holes are preferably polygons, and ideally square in shape, and filled with a dielectric material. Additionally, the minimum necessary perimeter of the runway should include an extended portion in an irregular pattern about a least a portion of the necessary perimeter. This portion should also incorporate the randomly positioned and orientated holes.

18 Claims, 2 Drawing Sheets

AIRCRAFT RUNWAY

TECHNICAL FIELD

The invention relates to the field of aircraft runways and, in particular, to aircraft runways with reduced radar detectability.

BACKGROUND OF THE INVENTION

It is obviously important to reduce the probability of detection of aircraft runways in combat or near combat zones. Protection, in the past, has depended primarily upon reduction in the visual signature, mainly accomplished by camouflage painting. However, modern airborne radar systems can easily detect runways because of their relative smoothness compared to the surrounding terrain and the long and straight sides thereof. Some reduction in detectability is provided by the use of corner reflectors placed along the sides and at the front and rear ends of the runway. While increasing the radar signature, the characteristic radar signature of the runway is decreased. However, this has not proved adequate. Of course, false structures can be moved onto the runway to provide increased clutter; however, they must be removed prior to any aircraft landing or taking off therefrom. This can be quite a time consuming operation when the runway is typically between 3,000 to 6,000 feet in length. Another approach is to use active countermeasures which "jam" the threat radar. However, this equipment is expensive to both procure and maintain and, additionally, a crew is required to operate and maintain the equipment.

Thus it is a primary object of the subject invention to provide a passive system for reducing the radar detectability of a runway.

It is another primary object of the subject invention to provide a passive system for reducing the radar detectability of a runway which does not interfere with aircraft landings and takeoffs.

It is a further object of the subject invention to provide a passive system for reducing the radar detectability of a runway which does not require significant maintenance.

It is still a further object of the subject invention to provide a passive system for reducing the radar detectability of a runway which is low in cost.

DISCLOSURE OF THE INVENTION

The invention is a reduced radar detectable runway for decreasing the probability of any enemy aircraft locating and attacking the facility or requiring the aircraft to approach much closer to the runway to achieve detection thereof which would increase the likelihood of interception and destruction by defensive missiles or anti-aircraft guns. It will also reduce the possibility of "lock on" by incoming cruise missiles and the like.

The reduced radar detectable runway is essentially a runway having a plurality of holes randomly dispersed across and along the surface thereof, the holes being filled with a dielectric material. Preferably, the holes are polygon shaped with a square appearing to be the best shape. However, any shape could be used, such as a triangle or a circle. Preferably, the depth of the hole is equal to the distance between the opposing sides of the polygon (in the case of a square, it is equal to the length of the sides) or the diameter if the hole is a circle. The length of the side of the square or the distance between opposite principle surfaces, in general, or the diameter if the hole is a circle is generally defined by the equation:

$$L \text{ (length) in meters} = 45\,(6_o R \Theta_B \tau \lambda^2)^{\frac{1}{2}} \text{ in meters}$$

Where:

$6_o$ = normalized radar cross-section of surrounding terrain in (meters)$^2$

R = Range to threat radar in meters $\Theta_B$ = Beam width of radar in radians $\tau$ = Pulse length of radar in seconds $\lambda$ = Wave length of radar in meters It is also important to have at least one hole placed within the area defined by the threat radar resolution cell size. The length and width of such a cell are generally given by the following equations:

Width of cell $= R\Theta_B$

Length of cell $= (4.92 \times 10^8)\tau$

The dielectric material should have a relative permittivity of between 2.5 and 3.5 and the top surface should be textured to match that of the runway surface, and should also have a coefficient of friction generally equal thereto. Thus, thermosetting resins such as epoxies or a thermoplastic could be used, possibly reinforced with dielectric filamentary material such as fiberglass or Kevlar.

An additional reduction in radar detectability can be obtained by extending additional runway surface with a jagged edge about at least a portion of the periphery of the perimeter of the runway. Holes, also filled with a dielectric material, can be included in this portion.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

Illustrated in FIG. 1 is a partial plan form view of the reduced radar detectable runway and surrounding terrain.

Illustrated in FIG. 2A is an enlarged partial view of a portion of the runway shown in FIG. 1, particularly illustrating a square hole therein filled with a dielectric material.

Figure 2A:
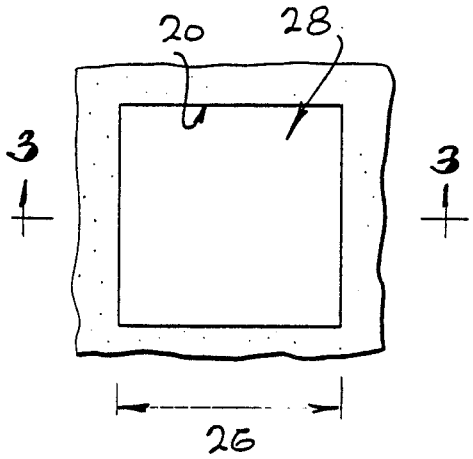
Figure 2B:
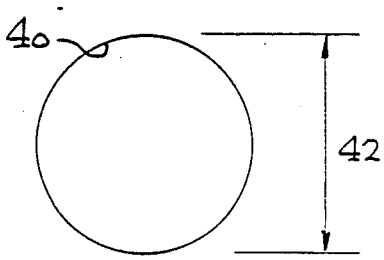

Illustrated in FIG. 2B is a view similar to FIG. 2A, except that the hole is hexagon shaped.

Figure 2C:
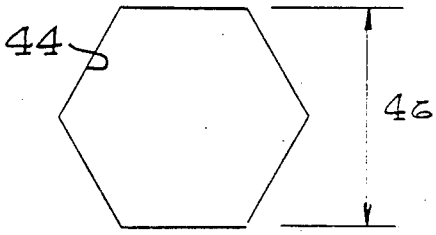

Illustrated in FIG. 2C is a round hole that could be used in place of the square hole shown in FIG. 2A.

Figure 3:
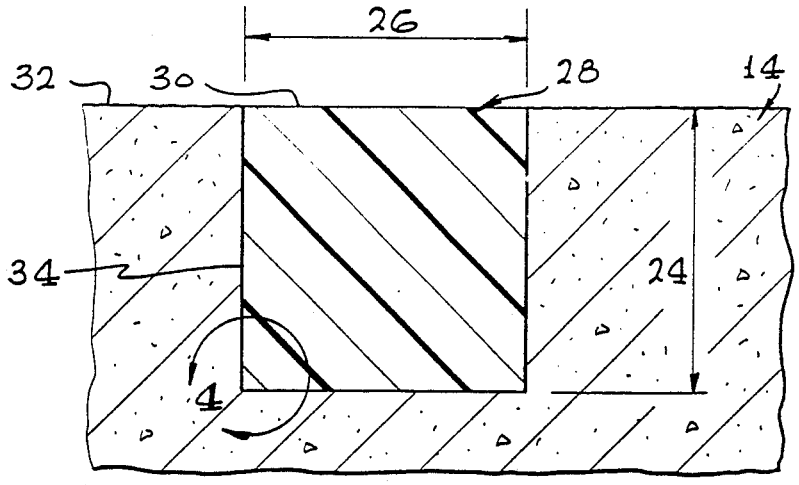

Illustrated in FIG. 3 is a cross-sectional view of the hole shown in FIG. 2A taken along the line 3—3.

Figure 4:
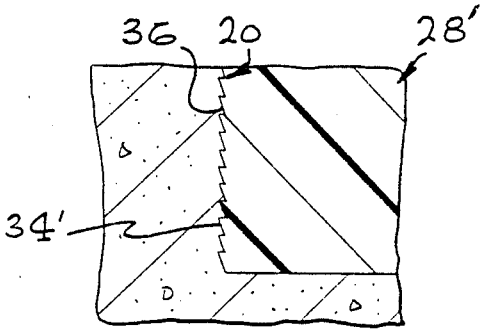

Illustrated in FIG. 4 is a cross-sectional view of a hole similar to that illustrated in FIG. 3 showing an alternate method of retaining the dielectric material in the hole.

BEST MODE FOR CARRYING OUT THE INVENTION

Figure 1:
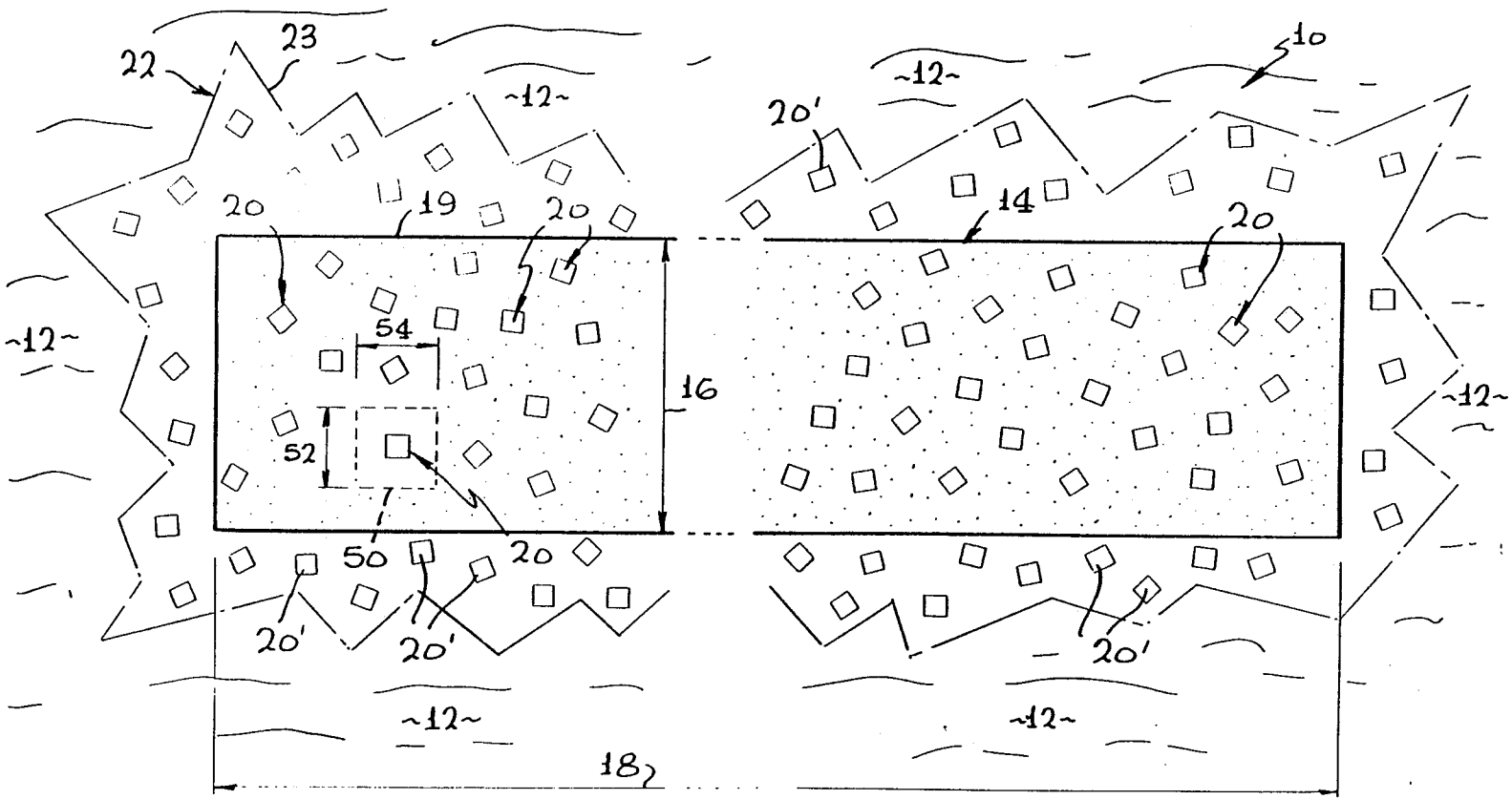

Referring to FIGS. 1, 2A, and 3, the reduced radar detectable runway system is generally designated by numeral 10 and is located in unimproved surrounding terrain 12. The terrain 12, for purposes of illustration, should be considered uneven and with numerous boulders and small trees thereon. The runway system 10 includes a runway 14 having a width 16 and a length 18 defining the periphery 19 thereof, which is necessary to land and take off aircraft. Typically, for fighter aircraft, the width 16 is between 60 and 100 feet, and the length 18 is between 3,000 and 6,000 feet. Clearly the long and flat runway 14 made of concrete or the like would present a large gap in the terrain 12 on a radarscope. To avoid this, a plurality of polygon-shaped holes, and as illustrated square holes 20, are located along the runway 14 with a random orientation. The holes 20 are shown oversized in relation to the runway for purposes of illustration. The random orientation is desirable because an enemy aircraft may approach the runway from any combination of elevation and Azimuth and the holes will have a "null" at some particular combination(s) thereof. However, most if not all air attacks will occur at an elevation of between 5 and 25 degrees; any larger elevation angle significantly increases the possibility of detection and intercept.

An additional reduction in radar detectability can be obtained by providing additional runway surface 22, with an irregular a jagged edges 23, about at least a portion of the periphery 19 of the runway 14 with an irregular a jagged edges 23 (as illustrated in FIG. 1 completely around the runway 14). This will blur the boundary between the runway 14 and the surrounding terrain 12. Holes, indicated by numeral 20', can also be located in this area.

The square hole 20 has a depth 24 and side walls of a length 26 which are preferably equal to each other. The holes 20 are filled with a dielectric material 28, preferably with a relative permittivity of between 2.5 and 3.5. The top surface 30 of the dielectric material is flush with the surface 32 of the runway 14 and preferably has the same surface texture, providing a coefficient of friction similar thereto (for concrete, this would be between 0.6 to 0.8). Thus, a thermoplastic or thermosetting resin is a good choice. These resins can be reinforced with filamentary material such as fiberglass or Kevlar, which are also dielectric in nature and which can be used for reinforcing the resin. Preferably, the dielectric material 28 is bonded at its side 34 to the wall of the hole to prevent it from moving upward. If the dielectric material were to protrude from the surface of the runway, it could be disastrous for aircraft landing and taking off. Illustrated in FIG. 4 is a portion of FIG. 3 indicated by numeral 4, showing an alternate retention method. Here the dielectric material 28' incorporates a plurality of barbs 36 on its sides 34' which will engage the whole wall, preventing its upward movement.

The best result will be provided if the length 26 of the square 20 is determined by the following equation:

$$\text{Length of square 26 in meters} = 45\,(6_o R \Theta_B \tau \lambda^2)^{\frac{1}{2}}$$

Where:

$6_o$ = normalized radar cross-section of surrounding terrain in (meters)$^2$

R = Range to threat radar in meters $\Theta$ = Beam width of radar in radians $\tau$ = Pulse length of radar in seconds $\lambda$ = Wave length of radar in meters If the hole were a polygon in general, then the equation could provide the distance between opposed sides, and if the hole were a circle, the diameter of the circle.

Hole size should be selected for ranges (R) from 2,000 to 10,000 meters. It is readily apparent that much of this information necessary to solve the equation, such as the most likely aircraft to attack the runway and the operating parameters of its radar must be obtained from intelligence sources. Since, there may be a range of radars, the size of the holes may have to be varied reducing the effectiveness against any specific radar.

Illustrated in FIGS. 2B and 2C are additional hole shapes that may be used. As illustrated, FIG. 2B is a circular-shaped hole 40, having a diameter 42, while FIG. 2C is a hexagon-shaped hole 44, having a distance between opposed surfaces indicated by numeral 46. In fact, almost any shaped hole (straight sided or irregular shaped) would be effective to some degree; however, the square hole appears to be best.

Referring back to FIG. 1, it can be seen that the holes 20 and 20' are randomly spaced on the runway 14 and additional runway surface 22. However, a maximum reduction in radar detectability is obtained, if at least one hole 20 or 20' is placed within an area defined by the threat radar resolution cell size, indicated by numeral 50. The size of the cell 50 is given by the following formulas:

Width 52 $= R\Theta_B$

Length 54 $= (4.92 \times 10^8)\tau$

Thus, it can be seen that the radar detectability of a runway can be significantly reduced by the incorporation of the holes filled with dielectric material. Further reductions can be obtained by extending the runway in a jagged pattern thereabout. Therefore, the objectives of the invention are met, (1) the system is passive,(2) the system does not effect the landing or takeoff of aircraft, (3) the system does not require significant maintenance; and finally, 4) its cost is much less than a sophisticated electronic systems.

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

Industrial Applicability

The invention has applicability to aircraft runways, and, in particular, to military aircraft runways requiring a reduction in radar detectability.

I claim:

1. A reduced radar detectable runway comprising:

a runway, having a necessary minimum perimeter and an extended portion in an irregular pattern about at least a portion of the minimum necessary perimeter; and a plurality of holes dispersed across and along the surface of said runway and said extended portion, said holes filled with a dielectric material.

2. The reduced radar detectable runway as set forth in claim 1, wherein said plurality of holes are randomly dispersed.

3. The reduced radar detectable runway as set forth in claim 2, wherein said holes are polygon shaped.

4. The reduced radar detectable runway as set forth in claim 3, wherein said holes are randomly oriented.

5. The reduced radar detectable runway as set forth in claim 3, wherein the distance L between opposed sides of said polygon shaped holes is generally defined by the following formula $$\text{L (length) in meters} = 45\,(6_o R\, \Theta_B \tau \lambda^2 1)^{\frac{1}{2}}$$

Where:

$6_\phi$=normalized radar cross-section of surrounding terrain in (meters)$^2$;

R=Range to threat radar in meters;

$\Theta_\tau$=Beam width of radar in radius;

$\tau$=Pulse length of radar in seconds; and $\lambda$=Wave length of radar in meters.

6. The reduced radar detectable runway as set forth in claim 5, wherein at least one hole is placed in an area defined by the radar resolution cell size wherein said cell size is generally defined by the formulas:

Width of said cell=$R\Theta_B$; and

Length of said cell=$(4.92\times10^8)\tau$.

7. The reduced radar detectable runway as set forth in claim 6, wherein the distance between opposed side of said polygon shaped holes are substantially equal to the depth of said holes.

8. The reduced radar detectable runway as set forth in claim 7, wherein said surface of said runway is textured and said upper surface of said dielectric material is flush with said surface of said runway and is generally textured to match said textured surface of said runway.

9. The reduced radar detectable runway as set forth in claim 8, wherein said dielectric material has a relative permittivity of between 2.5 and 3.5.

10. The reduced radar signature runway as set forth in claim 9, wherein said hole is square shaped.

11. The reduced radar signature runway as set forth in claim 1, wherein said holes are circular shaped.

12. A reduced radar detectable runway comprising:

a runway; and a plurality of polygon-shaped holes dispersed across and along the surface of said runway, said holes filled with a dielectric material the distance L between opposed sides of said polygon shaped holes is generally defined by the following formula:

$$L\text{ (length) in meters}=45(6_\phi R\ \Theta_B\tau\lambda^2)^{174}$$

Where:

$6_\phi$=normalized radar cross-section of surrounding terrain in (meters)$^2$;

R=Range to threat radar in meters;

$\Theta_B$=Beam width of radar in radius;

$\tau$=Pulse length of radar in seconds; and $\lambda$=Wave length of radar in meters.

13. The reduced radar detectable runway as set forth in claim 12, wherein said plurality of polygon-shaped holes are randomly dispersed.

14. The reduced radar detectable runway as set forth in claim 13, wherein at least one polygon-shaped hole is placed in an area defined by the radar resolution cell size wherein said cell size is generally defined by the formula:

Width of said cell=$R\Theta_B$; and

Length of said cell=$(4.92\times10^8)\tau$.

15. The reduced radar detectable runway as set forth in claim 14, wherein the distance between opposed side of said polygon shaped holes are substantially equal to the depth of said holes.

16. The reduced radar detectable runway as set forth in claim 15, wherein said surface of said runway is textured and said upper surface of said dielectric material is flush with said surface of said runway and is generally textured to match said textured surface of said runway.

17. The reduced radar detectable runway as set forth in claim 16, wherein said dielectric material has a relative permitivity of between 2.5 and 3.5.

18. The reduced radar signature runway as set forth in claim 17, wherein said hole is square shaped.

* * * * *